US007010933B2

(12) United States Patent
Ishitomi et al.

(10) Patent No.: US 7,010,933 B2
(45) Date of Patent: Mar. 14, 2006

(54) ICE-MAKING MECHANISM OF ICE-MAKING MACHINE

(75) Inventors: Kunihiko Ishitomi, Toyoake (JP); Masaaki Kawasumi, Toyoake (JP); Kenji Takahashi, Toyoake (JP); Shizuma Kadowaki, Toyoake (JP); Shinichi Nagasawa, Toyoake (JP); Tadaharu Hosogi, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 0 days.

(21) Appl. No.: 10/818,603

(22) Filed: Apr. 6, 2004

(65) Prior Publication Data

US 2004/0226311 A1 Nov. 18, 2004

(30) Foreign Application Priority Data

Apr. 11, 2003 (JP) ..... 2003-108362
Mar. 17, 2004 (JP) ..... 2004-076415

(51) Int. Cl.
*F25C 1/12* (2006.01)

(52) U.S. Cl. ..... 62/347; 62/348

(58) Field of Classification Search ..... 62/74, 62/347, 348
See application file for complete search history.

(56) References Cited

U.S. PATENT DOCUMENTS 2,775,100 A * 12/1956 Howe ..... 62/348
2,921,447 A * 1/1960 Gottschalk ..... 62/139
3,058,319 A * 10/1962 Lees ..... 62/348
3,254,501 A * 6/1966 Brysselbout ..... 62/138
3,686,890 A * 8/1972 Lyman ..... 62/67
4,262,489 A 4/1981 Sakamoto
4,375,756 A 3/1983 Lanzani
4,589,261 A * 5/1986 Ohashi et al. ..... 62/73
4,641,501 A 2/1987 Simkens
5,239,836 A * 8/1993 Sakai ..... 62/233
5,894,734 A 4/1999 Morishita et al.
6,058,731 A * 5/2000 Byczynski et al. ..... 62/344
6,112,533 A * 9/2000 Kato et al. ..... 62/188
6,116,038 A * 9/2000 Yamada et al. ..... 62/259.1
6,453,696 B1 * 9/2002 Kawasumi et al. ..... 62/344
6,484,530 B1 11/2002 Hibino et al.

FOREIGN PATENT DOCUMENTS

EP JP 09-269166 10/1997
EP JP 2002-257442 9/2002

* cited by examiner

*Primary Examiner*—William E. Tapolcai
(74) *Attorney, Agent, or Firm*—Koda & Androlia

(57) ABSTRACT

An ice-making water tank 54 capable of improving ice-making efficiency by suppressing increases in concentrations of the impurities contained in ice-making water is divided into a circulating tank section 58 and a retention tank section 60 by a partition plate 62. The ice-making water stored within the circulating tank section 58 and the ice-making water stored within the retention tank section 60 are made movable between each other by a communication hole 64. A capacity of the retention tank section 60 is set to have a capacity greater than that of the circulating tank section 58. Above the retention tank section 60 is covered with a guide 52*c* of a mechanical base 52, and the un-iced water cooled during ice-making operation is collected only into the circulating tank section 58 via an opening 52*d* opening downward above the circulating tank section 58.

6 Claims, 10 Drawing Sheets

(a)

(b)

ICE-MAKING MECHANISM OF ICE-MAKING MACHINE

FIELD OF THE INVENTION

The present invention relates to an ice-making mechanism of an ice-making machine, and more particularly, to an ice-making mechanism of an ice-making machine which spray-supplies ice-making water upwards to a plurality of ice-making compartments opening downward, for example, and thus continuously manufactures ice cubes (masses of ice).

DESCRIPTION OF THE RELATED ART

Spray-type automatic ice-making machines that spray-supply ice-making water from an upward direction to a plurality of ice-making compartments opening downward and thus continuously manufacture ice cubes (masses of ice) are conveniently used in the kitchens of coffee shops, restaurant, and other facilities. As shown in FIG. 10, the ice-making mechanisms of such spray-type automatic ice-making machines include a so-called closed-cell type of ice-making mechanism 10 (refer to, for example, Japanese Unexamined Utility Model Registration Publication No. Hei 6-28568). This ice-making mechanism 10 has partition plates 14 arranged in both vertical and horizontal directions at a bottom of an ice-making chamber (ice-making unit) 12 disposed horizontally in a storage chamber to form a large number of ice-making compartments 16 in the form of grid opening downward. At a top of the ice-making chamber 12, evaporation pipes 16 communicating with a refrigerating system (not shown) are arranged in close contact with one another and in a meandering fashion to circulate a refrigerant during ice-making operation and thus to forcedly cool the above-mentioned ice-making compartments 16. In addition, directly under the ice-making chamber 12, a water tray 22 having an ice-making water tank 20 formed thereunder integrally with in order to reserve ice-making water in a stored condition is pivotally supported in a tiltable state by a support axis (not shown). The water tray 22 and the ice-making water tank 20 are adapted so that during ice-making operation, both are positioned horizontally and maintained in parallel to the ice-making chamber 12, and so that during deicing operation, both are energized by a water tray opening/closing mechanism (not shown) and incline around the above-mentioned support axis so as to open the ice-making compartments 16.

In the above-mentioned water tray 22, a large number of water-spraying holes 24 and return holes (not shown) are each provided under an associated relationship with respect to respective positions of the ice-making compartments 16. In addition, at an underside of the water tray 22, a distribution pipe 28 plurally branched from a pressure chamber 26 is provided, and the distribution pipe 28 communicates with the above-mentioned water-spraying holes 24. A pump motor 30 is connected to a bottom of the ice-making water tank 20 via a suction pipe 32, and the pump motor 30 is adapted so as to be able to pressure-feed, to the distribution pipe 28 via a discharge pipe 34 and the pressure chamber 26, the ice-making water in the ice-making water tank 20 sucked via the suction pipe 32. The ice-making water is thus sprayed from each water-spraying hole 24 into the corresponding ice-making compartment 16 associated therewith. Ice-making water that has not become iced in any ice-making compartment 16 (i.e., un-iced water) is collected into the ice-making water tank 20 via the above-mentioned return hole and directed for re-circulation.

A drainage tray 36 that collects the ice-making water discharged from the tank 20 which inclined during deicing operation is disposed below the ice-making water tank 20, and the ice-making water, after being collected in the drainage tray 36, is drained from a draining hole 36*a* provided in the drainage tray 36, to the outside of the machine. Furthermore, an opening of a water supply pipe 38 is positioned above the water tray 22, and during deicing operation, tap water of ordinary temperature is supplied from the water supply pipe 38 to the water tray 22. The tap water is collected into the ice-making water tank 20 via the above-mentioned return holes and used as ice-making water for next ice-making operation. In addition, the tap water (ice-making water) exceeding the amount of ice-making water required for ice-making operation is drained from a draining port 40 provided at an opposite end (open end) to a pivoted end of the water tray 22, onto the drainage tray 36.

As shown in FIG. 11, in a so-called open-cell type of ice-making mechanism 11 which does not incline a water tray when deicing ice cubes, an ice-making water tank 20 has an overflow pipe 42 therein so that the tap water (ice-making water) exceeding the amount of ice-making water required during ice-making operation is drained via the pipe 42. That is to say, a capacity of the ice-making water to be stored in the ice-making water tank 20 is defined by a height position of the overflow pipe 42. For the ice-making mechanism 11 shown in FIG. 11, the same numeral is allotted for each of the members having the same function as that of the members of the ice-making mechanism 10 shown in FIG. 10. In addition, in FIG. 11, numeral 44 denotes a guide plate which guides into an ice storage compartment (not shown), the ice cubes that drop off from ice-making compartments 16.

The operation of the ice-making mechanism 10 of FIG. 10 according to the above construction is briefly described below. When ice-making operation is started with the foregoing ice-making compartments 16 closed by the water tray 22, the refrigerant circulates through the above-mentioned evaporation pipe 18, whereby the ice-making compartments 16 are forcedly cooled. In addition, the ice-making water in the ice-making water tank 20 is pressure-fed by the pump motor 30 and spray-supplied to the ice-making compartments 16 via the distribution pipe 28 and the water-spraying holes 24. The ice-making water is cooled at the inner wall surfaces of the ice-making compartments 16 and partially begins to freeze in a laminar form. Ice-making water that has not become iced is collected into the ice-making water tank 20 via the return holes of the water tray 22. When ice-making operation progresses and ice cubes are grown in the ice-making compartments 16, this state is detected by a required sensor and the operation is switched to deicing operation.

Next, a valve provided in the refrigerating system changes over and a hot gas is supplied to the evaporation pipe 18 in order to heat the ice-making compartments 16 and operate the water tray opening/closing mechanism to incline the water tray 22 and the ice-making water tank 20. Thus, the ice-making compartments 16 are fully opened and ice cubes are discharged toward the inside of an ice storage compartment (not shown). When the ice-making water tank 20 inclines, the ice-making water in the tank is discharged from the draining port 40 thereof and drop onto the above-mentioned drainage tray 36 and are collected. When ice cubes are discharged from the ice-making compartments 16, the water tray opening/closing mechanism inversely operates to return the water tray 22 and the ice-making water tank 20 to a horizontal posture, thus closing the ice-making compartments 16 from below once again. At this time, although the ice-making water tank 20 has almost been emptied by the discharge of the ice cubes, the tap water supplied from the water supply pipe 38 to the water tray 22 drops via the return holes thereof to recover the water level progressively. The tap water (ice-making water) supplied in the ice-making water tank 20 exceeding the amount of ice-making water required during ice-making operation is drained onto the drainage tray 36 via the draining port 40.

In the open-cell type of ice-making mechanism 11 shown in FIG. 11, the ice-making water in the ice-making water tank 20 is pressure-fed into a sprinkling pipe 43 by the pump motor 30 and spray-supplied, via the water-spraying holes 24, to each ice-making compartment 16 previously force-cooled by the evaporation pipe 18 during ice-making operation. Part of the ice-making water is cooled on the inner wall surface of the ice-making compartments 16 and begins to freeze in a laminar formed ice. Ice-making water that has not become iced is collected into the ice-making water tank 20. When ice-making operation is completed and changed over to deicing operation, a hot gas is supplied to the evaporation pipe 18 in order to heat the ice-making compartment 16, and the ice cubes dropping off from the ice-making compartment 16 are discharged into the ice storage compartment via the guide plate 44. When deicing operation is completed and changed over to ice-making operation, a required amount of tap water is supplied from the water supply pipe 38 to the ice-making water tank 20.

In the closed-cell or open-cell type of ice-making mechanism 10 or 11, respectively, if concentrations of the impurities contained in the ice-making water stored within the ice-making water tank 20 increase too significantly, this may cause the problems that masses of ice become clouded to deteriorate in appearance or become fused too early or that the masses of ice inside the ice storage compartment easily stick to one another. Therefore, a greater amount of ice-making water than the amount of water substantially required for ice making is stored in the tank 20 to suppress increases in the concentrations of impurities. In addition, ice-making water left in the ice-making water tank 20 after completion of is entirely discarded or is diluted by supplying new ice-making water, whereby the concentrations of impurities in the ice-making water are prevented from increasing.

In such a case, the ice-making water that was cooled during the previous ice-making operation cannot be effectively used, which causes a great loss of energy. In addition, since the temperature of the ice-making water stored within the ice-making water tank 20 reaches ordinary temperature, the problem is pointed out that the time to cool the great amount of ice-making water within the ice-making tank 20 in next ice-making operation is required, so that a longer ice-making cycle is caused to invited a deterioration of ice-making efficiency.

SUMMARY OF THE INVENTION

In view of the foregoing problems inherent in the ice-making mechanisms of ice-making machines according to conventional technology, the present invention was proposed to solve the problems appropriately and an object of the invention is to provide an ice-making mechanism of an ice-making machine, capable of achieving the improvement of ice-making efficiency, based on the suppression of increases in concentrations of the impurities contained in ice-making water.

In order to overcome the above problems and achieve the required object, an ice-making mechanism of an ice-making machine, according to the present invention, is characterized in that in an ice-making machine adapted in such a manner that the ice-making water stored within an ice-making water tank disposed below an ice-making unit cooled by evaporation pipes will be supplied to the ice-making unit via a pump motor and that the ice-making water not becoming iced in the ice-making unit will be collected into the ice-making water tank and recirculated, the ice-making water tank is constituted by a circulating tank section to which the pump motor is to connect, and a retention tank section set to a capacity larger than that of the circulating tank section, wherein both tank sections communicate with each other, and above the ice-making water tank is provided guide means for guiding only to the circulating tank section the ice-making water un-iced mentioned above.

DETAILED DESCRIPTION OF THE PREFERRED EMBODIMENTS

Figure 10:
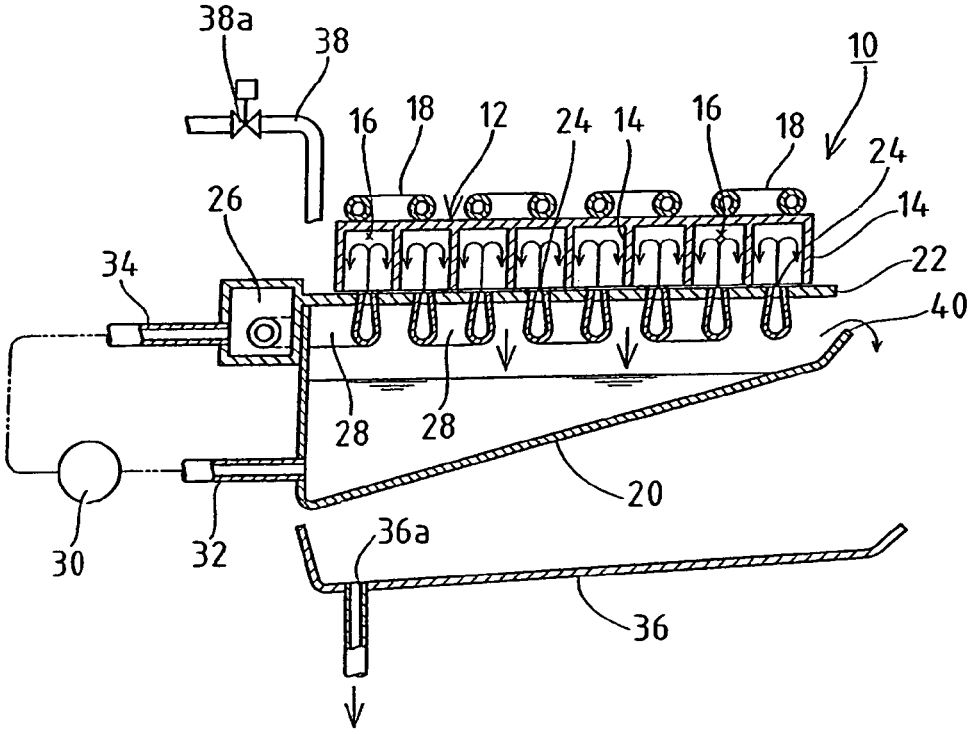
FIG. 10 PRIOR ART
FIG. 10 is a longitudinally sectional front view showing the ice-making mechanism of an ice-making machine according to conventional technology.
Figure 11:
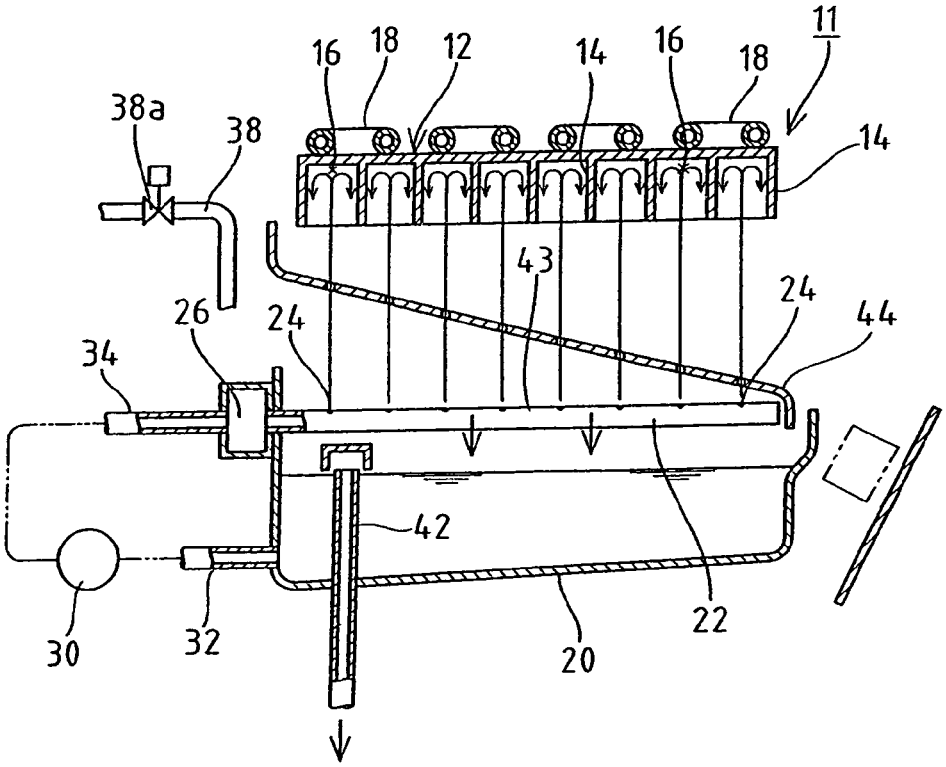
FIG. 11 PRIOR ART
FIG. 11 is a longitudinally sectional front view showing the ice-making mechanism of an ice-making machine according to another conventional technology.

Next, preferred embodiments of the ice-making mechanism of an ice-making machine according to the present invention are described below referring to the accompanying drawings. For the sake of convenience in description, the same numeral is used to denote each of the same elements as those of the ice-making mechanism of an ice-making machine, shown in FIG. 10 or 11, and detailed description of such constituting elements is omitted. In Embodiment 1, an open-cell type of ice-making mechanism is described. However, the description does not limit the said type of ice-making mechanism and the ice-making mechanism actually adopted may be of the closed-cell type constructed so as to incline a water tray with respect to an ice-making chamber by use of a driving mechanism and close the ice-making chamber during ice-making operation. Alternatively, the ice-making mechanism may be of the flow-down type adapted to allow ice-making water to flow downward onto the surface of an ice-making plate, or may be of other types. In addition, a shape of the ice made is, of course, not limited to a cubic form.

Embodiment 1)

(Outline)

Figure 1:
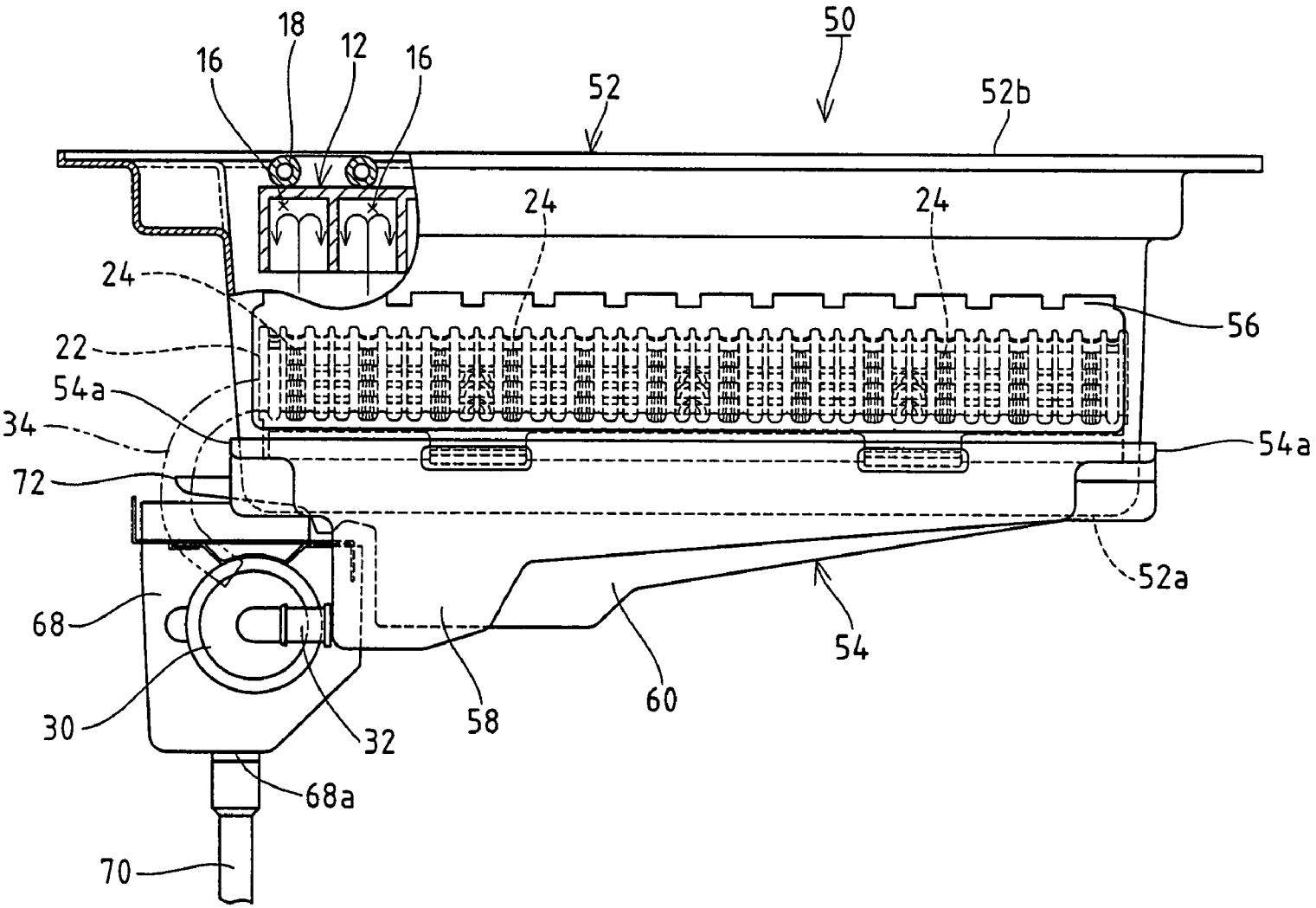
FIG. 1 is a front view showing in partly cut away the ice-making mechanism of an ice-making machine according to preferred Embodiment 1 of the present invention.

As shown in FIG. 1, an ice-making mechanism 50 according to Embodiment 1 includes: an ice-making chamber (ice-making unit) 12 formed with a large number of ice-making compartments 16 installed proximately to a top of a box-like mechanical base 52 so as to open downward; a water tray 22 with water-spraying holes 24 provided so as to be each associated with each of the ice-making compartments 16; and an ice-making water tank 54 provided, below the water tray 22, to reserve a required amount of ice-making water in a stored condition and to collect the un-iced water described below. At a top of the ice-making chamber 12, evaporation pipes 18 communicating with a refrigerating system (not shown) are arranged in close contact with one another and in a meandering fashion to circulate a refrigerant during ice-making operation and thus to force-cool the above-mentioned ice-making compartments 16. After completion of ice-making operation, each ice-making compartment 16 is heated by a hot gas to promote the deicing of an ice cube (mass of ice) 46. In addition, at one face of a side wall of the mechanical base 52, a shutter 56 with a pivotally supported upper end which functions as a discharge port for the ice cube 46 is provided and the shutter 56 is usually hanging in closed position by gravity. A pump motor 30 by which the ice-making water stored within the ice-making water tank 54 is pressure-fed toward the water-spraying holes 24 is disposed, at one of lateral sides of the ice-making water tank 54, proximately below a retention tank section 60 (described later). The pump motor 30 has its suction pipe 32 connected to a suction port 58*a* of a circulating tank section 58 (described later), and also has a discharge pipe 34 connected to the water tray 22. The motor 30 is adapted so that it, when driven, will pressure-feed to the water tray 22 the ice-making water sucked via the suction pipe 32. A shown in FIG. 3, a water supply port 38*b* of a water supply pipe 38 for replenishing the ice-making water tank 54 with tap water (ice-making water) is disposed above the ice-making water tank 54 so as to face the upper inside thereof, and a water valve 38*a* inserted into the water supply pipe 38 is opened to supply tap water.

(Ice-Making Water Tank)

Figure 2:
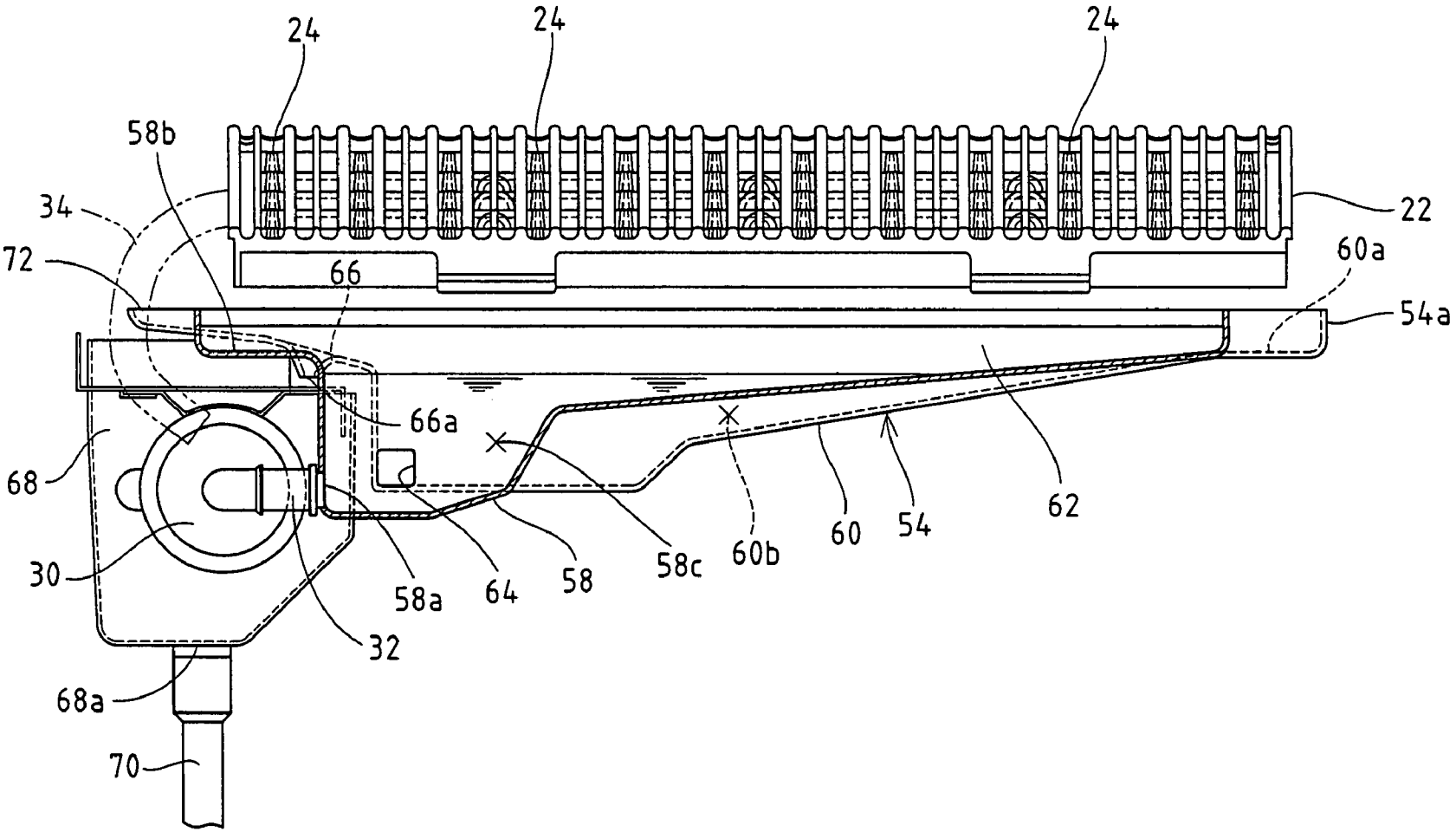
FIG. 2 is a front view showing, longitudinally in section, major sections of the ice-making mechanism of an ice-making machine according to Embodiment 1.
Figure 3:
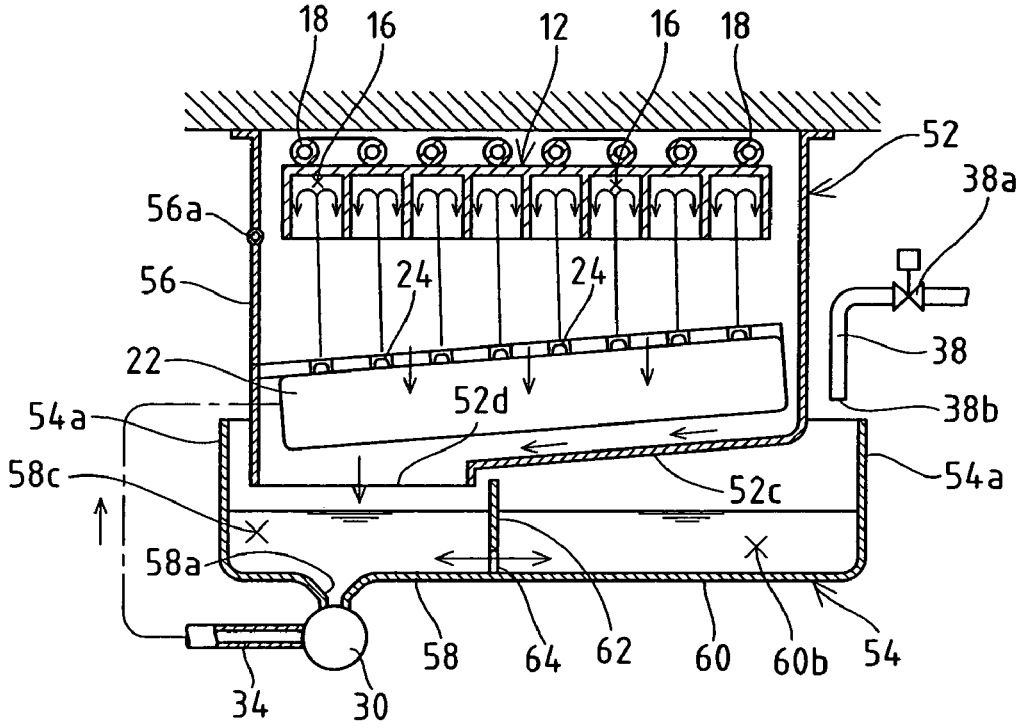
FIG. 3 shows the ice-making mechanism of an ice-making machine according to Embodiment 1, wherein (a) is a sectional side view schematically showing a state existing during ice-making operation, (b) is a sectional side view schematically showing a state during deicing operation.
Figure 3:
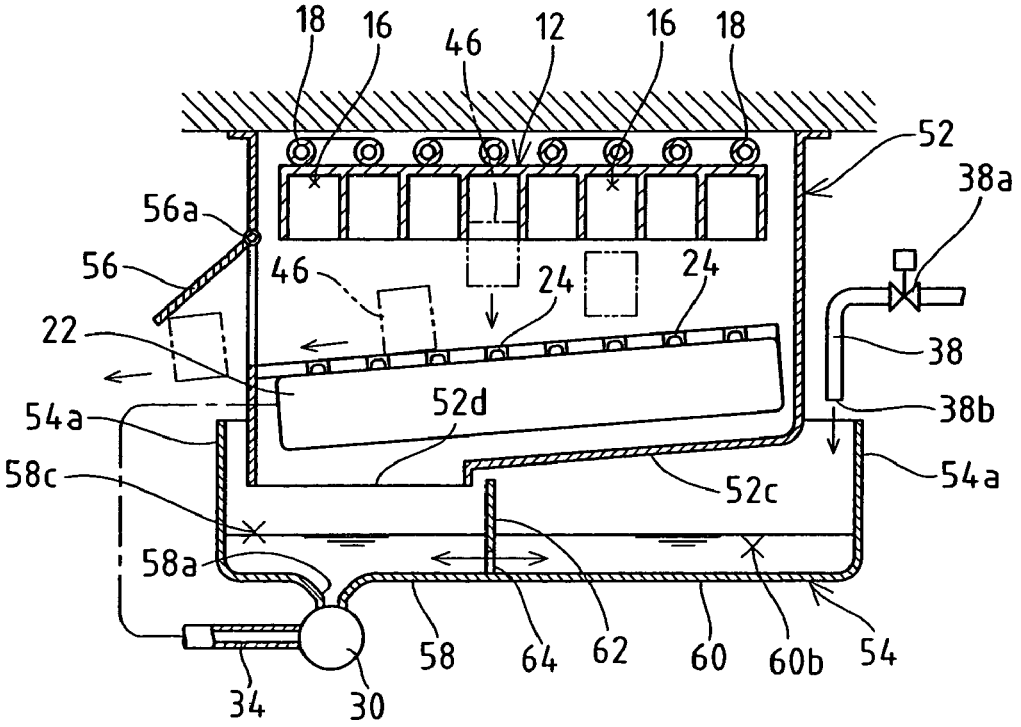
Figure 4:
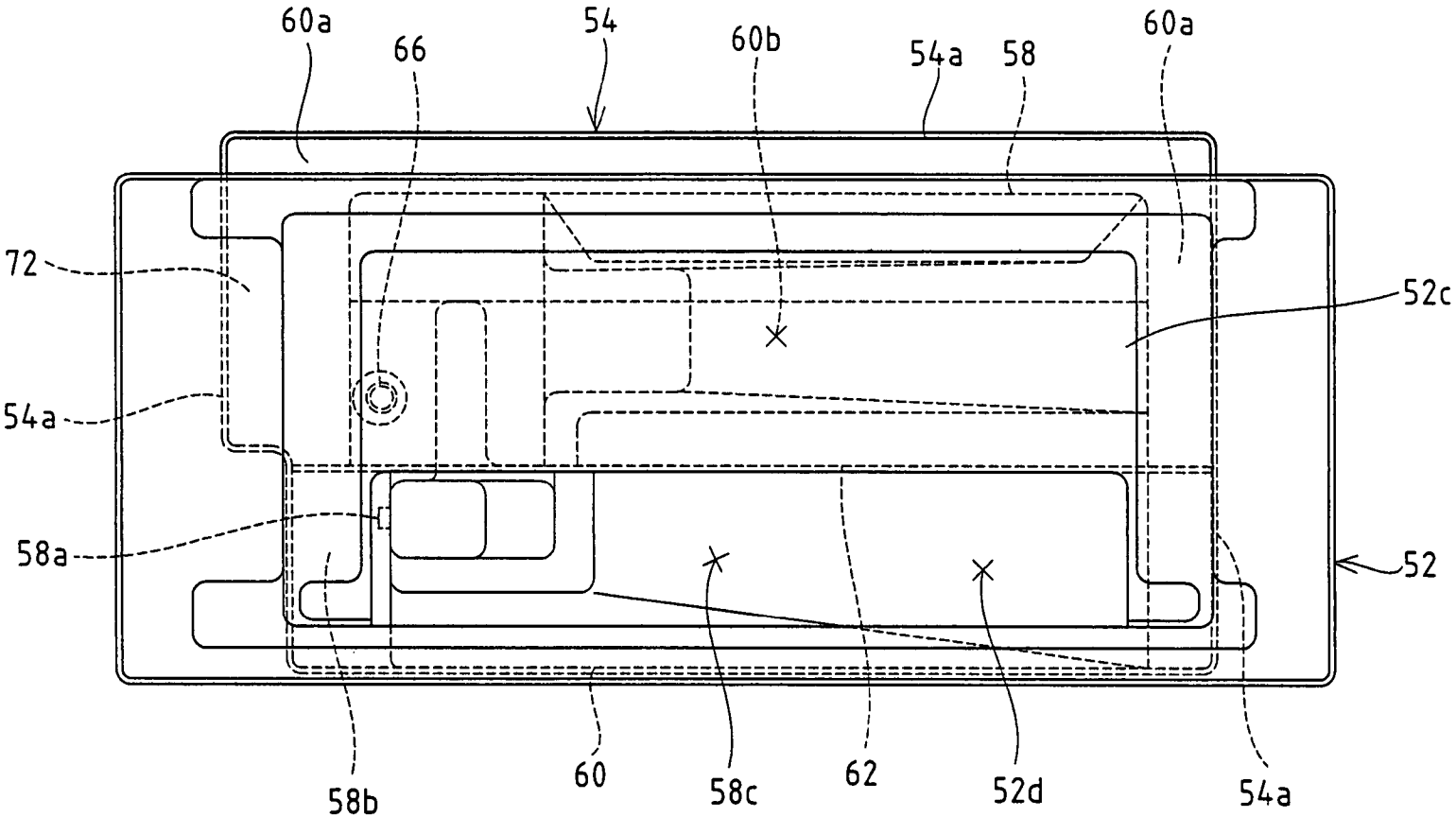
FIG. 4 is a plan view showing the major sections of the ice-making mechanism of an ice-making machine according to Embodiment 1.

The above-mentioned ice-making water tank 54 is, as shown in FIGS. 1 to 3, an upwardly open box unit disposed below the mechanical base 52 and having a rectangular shape when planarly viewed, and, for example, a mold made of synthetic resin is employed as the ice-making water tank 54. The inside of the ice-making water tank 54 is divided into a circulating tank section 58 and a retention tank section 60 by a partition plate 62 extending over a longitudinal section of the tank 54. An opening size of an upper edge of the ice-making water tank 54 is set to a size which allows a bottom 52*a* of the mechanical base 52 to be inserted internally. In addition, the circulating tank section 58 and the retention tank section 60 communicate with each other through a communication hole 64. The communication hole 64 is provided at a position proximate to a bottom of the partition plate 62, at one of the lateral sides of the ice-making water tank 54, i.e., at a side facing the pump motor 30 (see FIG. 2).

(Circulating Tank Section)

The above-mentioned circulating tank section 58 has its interior formed of a top-stage portion 58*b* set to a relatively shallow depth, and a circulation portion 58*c* set to have a depth greater than that of the top-stage portion 58*b* in order to reserve ice-making water in a stored condition. On the side where the pump motor 30 is installed at the depths of the circulation portion 58*c*, a suction port 58*a* is provided that connects to the pump motor 30. In addition, the circulation portion 58*c* is tilted so as to incline downward toward the suction port 58*a*, whereby the ice-making water stored will be led into the suction port 58*a*. Furthermore, a capacity of the circulating tank section 58 is set to have the amount of water required for the circulation of the ice-making water. That is to say, in light of the factors required for ice-making operation, such as a capability of the pump motor 30, an ice-making rate in the above-mentioned ice-making compartments 16, and the amount of water required when it circulates through a supply pipe, the water tray 22, and other elements forming a circulation route, the capacity of the tank section 58 is set to have a capacity at which air is not taken into the pump motor 30 by a shortage of ice-making water.

(Retention Tank Section)

The retention tank section 60 communicating with the above-mentioned circulating tank section 58 via the communication hole 64 is set to have a capacity greater than that of the circulating tank section 58. The retention tank section 60 has its interior formed of a top-stage portion 60*a* set to a relatively shallow depth, and a retention portion 60*b* set to have a depth greater than that of the top-stage portion 60*a* in order to retain ice-making water. The retention portion 60*b* is tilted so as to incline downward toward the communication hole 64 provided in the partition plate 62, whereby the ice-making water retained will be led into the communication hole 64. In addition, in the top-stage portion 60*a*, a draining hole 66 for draining excess water is provided at a position proximate to a lateral side facing the pump motor 30. That is to say, the total capacity of the retention portion 60*b* of the retention tank 60 and the circulation portion 58*c* of the circulating tank section 58 becomes equal to the maximum amount of ice-making water storable into the ice-making water tank 54. The above-mentioned draining hole 66 extends downward, and below the draining hole 66, a drainage tray 68 is disposed in an upwardly open condition at a position where it receives the excess water drained from the draining hole 66. At a bottom of the drainage tray 68 is provided a draining port 68*a* so as to drain excess water from the machine via a pipe 70 connected to the draining port 68*a*. Furthermore, at the above-mentioned top-stage portion 60*a* of the retention tank section 60, a cover 72 for covering above the pump motor 30 is integrally formed extending to a further outward side of the pump motor 30 with respect to the draining hole 66.

The amount of ice-making water stored in the entire ice-making water tank 54, in other words, the amount of water stored in the retention tank section 60 and the circulating tank section 58 is set to a value at which the occurrence of the inconveniences described above due to increases in concentrations of the impurities contained in ice-making water is suppressible during ice-making operation.

(Mechanical Base)

The above-mentioned mechanical base 52 is a box-like synthetic resin mold (or the like) set to have dimensions that allow an ice-making chamber 12 and a water tray 22 to be disposed inside the mechanical base 52, with an upper end 52*b* of the mechanical base 52 being opened and an edge thereof being bent into a flange shape (see FIG. 1). A lower portion 52*a* of the mechanical base 52 is set to have the dimensions that make it possible to insert the lower portion 52*a* into an upper edge 54*a* of the aforementioned ice-making water tank 54 installed below the lower portion 52*a*. In addition, at a bottom of the mechanical base 52, a guide 52*c* as guide means for entirely covering above the aforementioned retention tank section 60 is provided and an opening 52*d* is formed above the circulating tank section 58. The guide 52*c* is sloped downward from one of longitudinal sides of the mechanical base 52, toward the front end (edge of the opening 52*d*) that faces the circulating tank section 58. The opening 52*d* is set so as to be positioned above a circulating portion 58*c* in the circulating tank section 58. Furthermore, on a longitudinal sidewall (side of the circulating tank section 58) of the mechanical base facing the lower sloped end of the water tray 22 that is slantways disposed in a lateral direction, a shutter 56 with an upper end pivotally supported by a support axis 56*a* is swingingly disposed and usually remains closed in a gravitationally suspended condition (see FIG. 3). Furthermore, corners of the box-like mechanical base 52 are all formed so as to be round.

[Operation of Embodiment 1]

The operation of the ice-making mechanism of an ice-making machine in Embodiment 1 is described below. First, an ice-making process by the ice-making mechanism in Embodiment 1 is briefly described using FIG. 3. When ice-making operation is started, a refrigerant circulates through the evaporation pipe 18 and the ice-making compartments 16 are force-cooled. Also, the ice-making water in the ice-making water tank 54 is pressure-fed to the water tray 22 by the pump motor 30 and spray-supplied to each ice-making compartment 16 via each water-spraying hole 24. The water is cooled on inner wall surfaces of the ice-making compartments 16 and begins to freeze in a laminar form. As shown in FIG. 3(*a*), un-iced water that has not become iced flows downward through the return hole of the water tray 22, then drips onto the guide 52*c* of the mechanical base 52 that is positioned below the guide 52*c*, and is dropwise collected from the opening 52*d* into the circulating tank section 58. In other words, the un-iced water dripping without becoming iced in the ice-making compartments 16 during ice-making operation is collected only into the circulating tank section 58 via the guide 52*c* and the opening 52*d*. When ice-making operation progresses and ice cubes 46 are produced in the ice-making compartments 16, this state is detected by a required sensor and the operation is switched to deicing operation.

Next, a valve provided in the refrigerating system changes over and a hot gas is supplied into the evaporation pipe 18 in order to heat the ice-making compartments 16. Thus, the ice cubes 46 are released from the ice-making compartments 16, then after dropping onto the water tray 22 disposed with a slope and sliding obliquely in a downward direction, open the shutter 56 provided on a sidewall of the mechanical base, and is delivered from the mechanical base to an ice storage compartment (not shown) (see FIG. 3(*b*)). When an ice cube 46 is discharged from an ice-making compartment 16, the shutter 56 gravitationally returns to an original position, thus closing the sidewall of the mechanical base once again. At this time, a decrement in the amount of ice-making water (tap water) in the ice-making water tank 20 during the previous ice-making operation is supplied from the water supply pipe 38 to the retention tank section 60, and thus the water level in the retention tank section 60 progressively returns to an original level to stand by for next ice-making operation. The tap water (ice-making water) stored in the ice-making water tank 54 in excess of the amount of ice-making water required for ice-making operation is drained onto the drainage tray 68 via the draining hole 66.

The ice-making mechanism according to Embodiment 1 is constructed so that the ice-making water tank 54 is divided into the circulating tank section 58 and the retention tank section 60 and so that during ice-making operation, the un-iced water cooled flows only into the circulating tank section 58 without directly flowing into the retention tank section 60. In short, during ice-making operation, since the ice-making water stored mainly within the circulating tank section 58 is cooled while circulating, a temperature of the ice-making water decreases within a short time, hereby allowing ice-making efficiency to be improved. Besides, the amount of ice-making water stored within the entire ice-making water tank 54 is set to a value at which any increases in concentrations of the impurities contained in ice-making water are suppressible and this prevents the occurrence of an inconvenience such as clouding or early fusing of ice cubes 46.

In addition, a capacity of the circulating tank section 58 is of such an extent as to prevent air from being taken into the pump motor 30 during ice-making operation, and is set to a capacity smaller than that of the entire ice-making water tank used in a conventional ice-making mechanism. That is, by setting the capacity of the circulating tank section 58 to a small value, the ice-making water in the tank section 58 is increased in velocity, and during ice-making operation, the flocculation of ice is suppressed since the ice-making water is constantly circulating through the circulating tank section 58. Furthermore, by setting the ice-making water to have a high velocity, it is possible to reduce the total amount of ice-making water required for one ice-making operation cycle. Reduction in the capacity of the circulating tank section 58 also allows reduction in the capacity of the entire ice-making water tank 54 and, hence, the miniaturization thereof.

The retention tank section 60 set to have a capacity greater than that of the circulating tank section 58 is adapted so that the un-iced water cooled during ice-making operation will not directly flow from the guide 52*c* of the mechanical base 52 disposed for covering above the retention tank section 60. More specifically, although the ice-making water in the retention tank section 60 is slowly cooled down from a temperature of the tap water supplied, the water is maintained at a temperature higher than that of the ice-making water in the circulating tank section 58. Therefore, the relatively high-temperature ice-making water supplied from the retention tank section 60 to the circulating tank section 58 via the communication hole 64 as the amount of ice-making water is reduced by the growth of ice in the ice-making chamber 16, can be used to prevent the ice-making water in the circulating tank section 58 from being supercooled, and thus to suppress the flocculation of ice. In addition, since the communication hole 64 in the partition plate 62 is provided in proximity to the suction port 58*a* in the pump motor 30 provided at the bottom of the circulating tank section 58, the flock of ice occurring in the pipes 32,34, the water-spraying holes 24, and the like, can be fused using the relatively high-temperature ice-making water supplied from the retention tank section 60.

By varying the capacity of the circulating tank section 58 in the ice-making water tank 54 and the capacity of the retention tank section 60 therein, it is possible to adjust a velocity of the water in the circulating tank section 58 and a heat exchange ratio between un-iced water and the ice-making water stored within the circulating tank section 58. In other words, increasing a capacity ratio of the retention tank section 60 in the ice-making water tank 54 with respect to the circulating tank section 58 therein makes it possible to increase the velocity in the circulating tank section 58, enhance a heat exchange ratio relative to the un-iced water, and cool the ice-making water within a short time so as to improve ice-making efficiency. However, if ice-making efficiency is enhanced only by changing the capacity ratio, flock of ice could easily occur, depending on conditions such as the outside air temperature. An opening area of the communication hole 64 provided in the partition plate 62, therefore, is increased/reduced to adjust the amount of ice-making water flowing from the retention tank section 60 into the circulating tank section 58. Consequently, a mixing ratio relative to the amount of ice-making water (tap water) within the circulating tank section 58 can be changed and flock of ice can thus be prevented from occurring. More specifically, increasing the opening area of the communication hole 64 prompts the convection occurring between the retention tank section 60 and the circulating tank section 58, causes a heat exchange between the relatively high-temperature ice-making water in the retention tank section 60 and the supercooled ice-making water in the circulating tank section 58, and suppresses the flocculation of ice. A sheathing plate or the like may therefore be provided so as to allow adjustment for increased or reduced opening area of the communication hole 64. Alternatively, the construction in which the circulating tank section 58 and retention tank section 60 constituting the ice-making water tank 54 are provided independently of each other and both are connected using a communication pipe or the like, can also be adopted.

During the above-mentioned ice-making operation, the ice-making water in the circulating tank section 58, cooled by un-iced water, and the ice-making water in the retention tank section 60 are heat-exchanged via the communication hole 64, and thus the ice-making water in the retention tank section 60 is also cooled. After completion of ice making, since the amount of ice-making water in the ice-making water tank 54 decreases, it becomes necessary to replenish the tank 54 with ice-making water. In this case, in the ice-making mechanism 50 of Embodiment 1, since the water supply port 38*b* in the water supply pipe 60 faces the inside of the retention tank section 60 in order to supply tap water thereto, the cooled ice-making water in the circulating tank section 58 preferentially remains in the circulating tank section 58, even if diluted. Compared with the ice-making water in the circulating tank section 58, that of the retention tank section 60 increases in temperature by means of the tap water supplied. That is to say, by supplying water for a minimum increase in the temperature of the circulating tank section 58 and making effective use of the low-temperature ice-making water cooled during the previous ice-making operation, it is possible to reduce energy losses and to improve ice-making efficiency. Furthermore, by maintaining in a relatively high-temperature state the ice-making water in the retention tank section 60, it is possible to accelerate the fusion of flocculated ice, as described above.

The draining hole 66 for draining the excess ice-making water in the above-mentioned ice-making water tank 54 is provided in the retention tank section 60 covered above by the guide 52*c* of the above-mentioned mechanical base. It is thus possible to prevent the draining of excess ice-making water due to the waving of its water surface, caused by the fact that the un-iced water in the ice-making chamber 16, i.e., the water that did not ice, drips onto the ice-making water surface. In addition, since the circulating tank section 58 onto which the un-iced water flows downward, and the retention tank section 60, are sectioned by the partition plate 62, the retention tank section 60 is not affected by the waving water surface of the ice-making water in the circulating tank section 58. Furthermore, since the draining hole 66 is provided in the top-stage portion 60*a* raised above the retention portion 60*b* and since an outer edge of the top-stage 60*a* (i.e., the upper edge 54*a* of the ice-making water tank 54) is extended further upward, if a too great amount of water to be drained from the draining hole 66 is supplied within a short time, the upper edge 54*a* functions as a shield, thus making it possible to prevent the water from flowing out to outside. Besides, since the bottom 52*a* of the mechanical base 52 is adapted so as to be inserted into the ice-making water tank 54, splashing of ice-making water to outside due to downward flow of un-iced water is prevented by being blocked by a sidewall of the mechanical base.

The ice-making chamber 12 and the water tray 22 are covered with the mechanical base 52, and dew condensation and other moisture occurring in the mechanical base 52 are guided to the guide 52*c* at bottom and collected from the opening 52*d* into the circulating tank section 58. Meanwhile, although a temperature difference between the inside of the mechanical base 52 and the ice storage compartment causes dew condensation to stick to the outside of the mechanical base, since the bottom thereof is inserted into the ice-making water tank 54, the dew condensation is led along an outer wall surface of the mechanical base 52 and collected into the ice-making water tank 54. Since corners of the mechanical base 52 are all formed into a round shape, the dew condensation flows downward along the outer wall surface of the mechanical base 52 and does not easily drop into the ice storage compartment located below. Furthermore, the top-stage portion 60*a* of the retention tank section 60 is formed with a cover 72 for covering above the pump motor 30. Accordingly, even if the water valve 38*a*, pipeline, etc. disposed above the pump motor 30 suffer damage or the like and water leakage occurs, drips of water are received by the cover 72 and the pump motor 30 is thus kept free from water. The dew condensation and other moisture that have thus been received by the cover 72 are drained from the draining hole 66. Since the cover 72 is formed extending from the top-stage portion 60*a* positioned above the retention portion 60*b* of the retention tank section 60 for storage of ice-making water, the pump motor 30 is not exposed to the ice-making water, even if the cover 72 is broken.

Embodiment 2

In Embodiment 1, the construction with the ice-making water tank 54 internally divided into the circulating tank section 58 and the retention tank section 60 and provided with the guide (guide means) 52*c* for guiding only to the circulating tank section 58 the ice-making water not becoming iced in the ice-making chamber (ice-making unit) 12, has been applied to the open-cell type of ice-making mechanism 50. For Embodiment 2 shown in FIGS. 5 to 9, however, application of the construction having an ice-making water tank 82 internally divided into a circulating tank section 84 and a retention tank section 86 and provided with a guide (guide means) 90 for guiding only to the circulating tank section 84 the ice-making water not becoming iced in an ice-making chamber (ice-making unit) 12, to a closed-cell type of ice-making mechanism 80 is described. A basic configuration of the ice-making mechanism 80 in Embodiment 2 is approximately the same as the closed-cell type of ice-making mechanism 10 described referring to FIG. 10. For the sake of convenience in description, therefore, the same numeral is used to denote each of the same elements, and detailed description of these elements is omitted.

(Outline)

Figure 5:
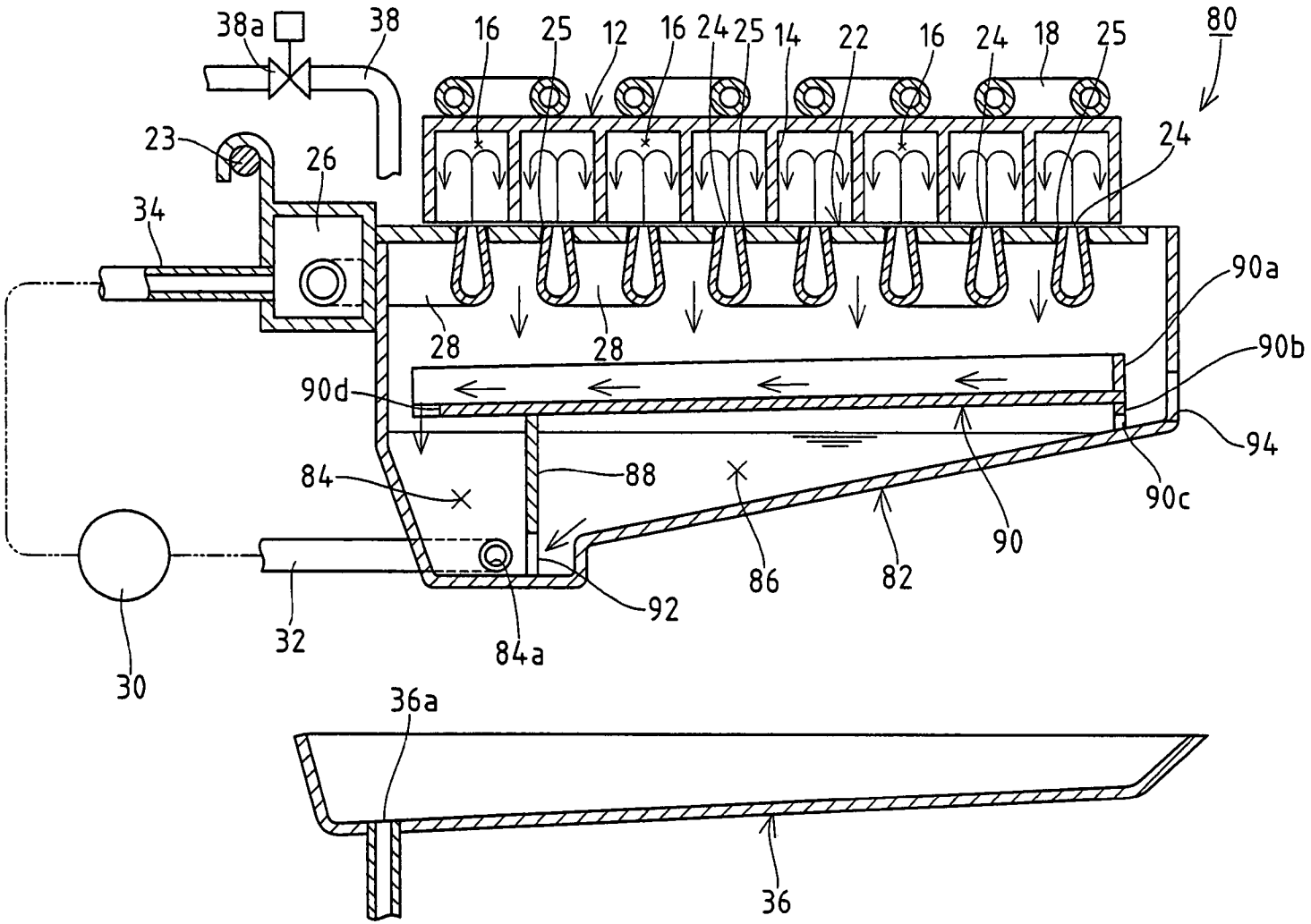
FIG. 5 shows the ice-making mechanism of an ice-making machine according to Embodiment 2, and is a sectional side view schematically showing a state during ice-making operation.
Figure 6:
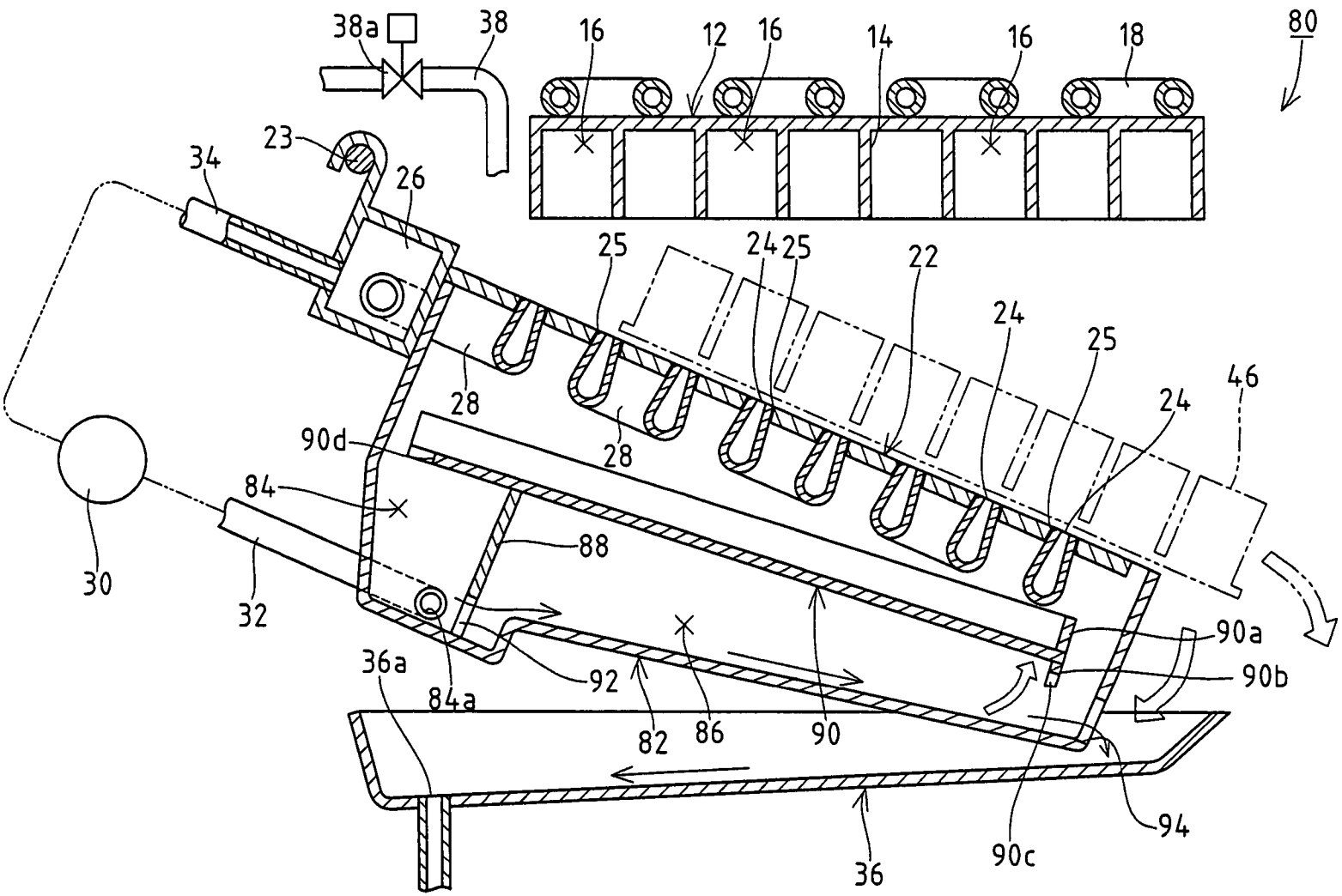
FIG. 6 shows the ice-making mechanism of an ice-making machine according to Embodiment 2, and is a sectional side view schematically showing a state during deicing operation.

As shown in FIG. 5, the closed-cell type of ice-making mechanism 80 is constructed so that ice-making chambers 16 each of which opens below an ice-making chamber 12 disposed horizontally in an ice storage compartment are closed in an opening and closing manner by a water tray 22 having an ice-making water tank 82 formed integrally with and below the water tray 22 in order to hold ice-making water in a stored condition. The water tray 22 is pivotally supported in a cantilever fashion under an inclinable state by a support axis 23, and urged by a water tray inclining mechanism (not shown). In addition, the water tray is adapted to move between a closing position (see FIG. 6) at which the water tray 22 closes the above-mentioned ice-making chambers 16 from below by inclining vertically around the above-mentioned support axis 23, and an opening position (see FIG. 6) at which the water tray 22 opens the ice-making chambers 16 by inclining downward for moving away therefrom.

(Water Tray)

The water tray 22 is set to have the dimensions allowing it to cover an underside of the ice-making chamber 12, and provided with a large number of water-spraying holes 24 and return holes 25 associated with respective positions of the ice-making chamber 16. The water tray 22 is adapted so that the ice-making water taken in from the ice storage chamber 82 by driving of a pump motor 30 will be sprayed toward the associated ice-making compartments 16 via the water-spraying holes 24. The return holes 25 each communicate with, and face from a top of the water tray 22, to the ice-making water tank 82 provided below the water tray 22, in order to lead to the ice-making water tank 82 the ice-making water (un-iced water) not becoming iced in the ice-making compartments 16 after flowing downward onto the water tray 22.

(Ice-Making Water Tank)

The ice-making water tank 82 provided below the water tray 22 integrally therewith is a box unit of a required depth, a suction port 84*a* is provided near a bottom of the tank 82, the pump motor 30 is connected to the suction port 84*a* via a suction pipe 32. In the ice-making water tank 82, a section in which the suction port 84*a* is provided is the deepest bottom section stepped down from all other bottom sections, and all the other bottom sections are sloped downward more significantly as they go away from sidewalls of the ice-making water tank 82 and go downward toward the deepest bottom section. Thus, the ice-making water stored within the ice-making water tank 82 is guided to the suction port 84*a*. Below the ice-making water tank 82 is disposed a drainage tray 36 for collecting the residual ice-making water discharged from the ice-making water tank 82 inclining during deicing operation, an excess of the tap water (ice-making water) supplied to the ice-making water tank 82, and other water, and the ice-making water collected into the drainage tray 36 is drained from the draining hole 36*a* provided in the drainage tray 36, to the outside of a machine.

Figure 8:
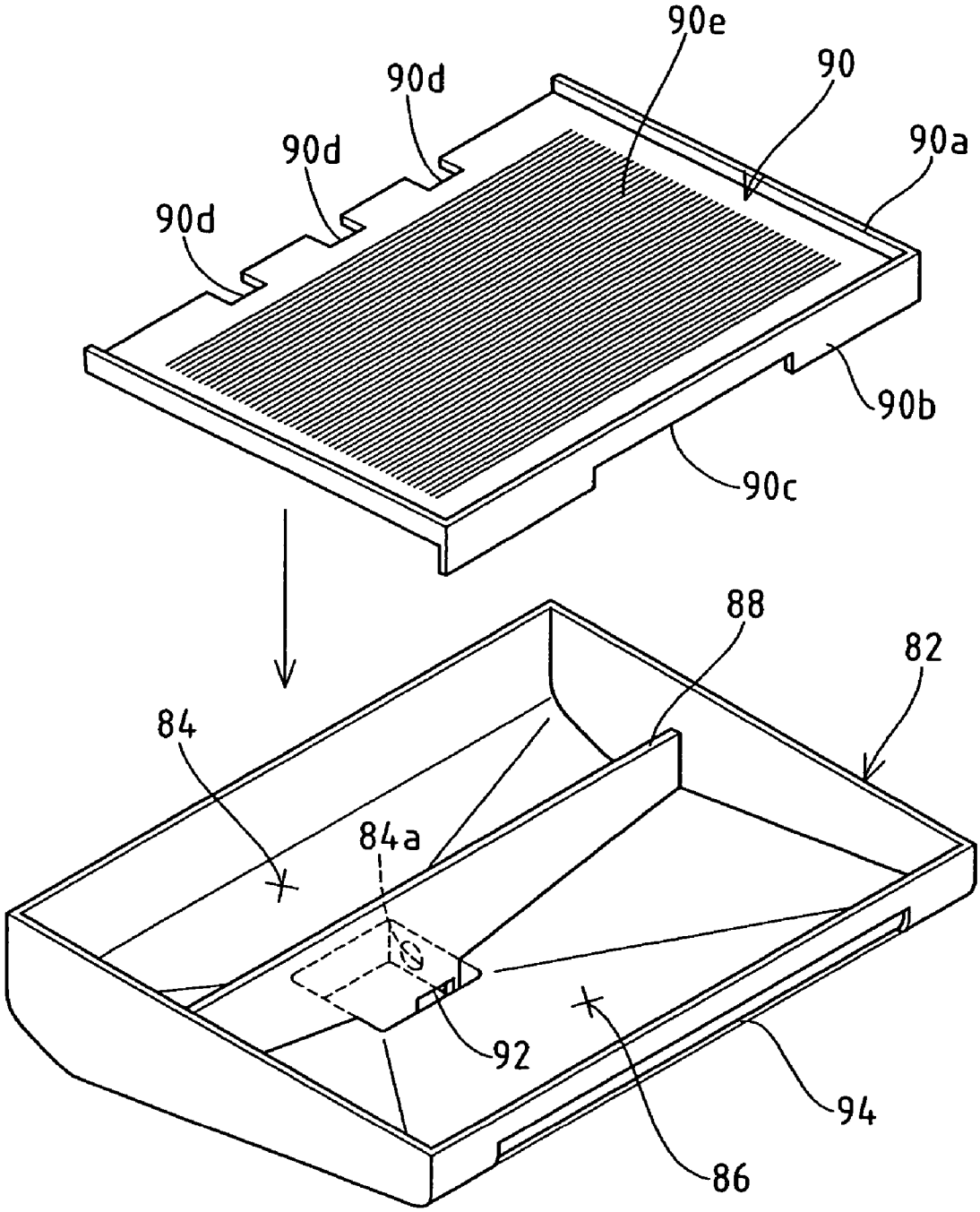
FIG. 8 is a schematic perspective view showing the ice-making water tank with a guide section separated therefrom in Embodiment 2.

As shown in FIG. 8, inside the ice-making water tank 82 are formed a circulating tank section 84 and retention tank section 86 divided by a partition plate 88 disposed so as to extend in an axial direction of a support axis 23 in the water tray 22. In other words, the circulating tank section 84 and the retention tank section 86 are positioned next to each other in a direction orthogonal to the axial direction of the support axis 23, and the suction port 84*a* is opened toward the circulating tank section 84. Also, the circulating tank section 84 and the retention tank section 86 communicate with each other by a communication hole 92 provided at a position proximate to a bottom of the partition plate 88, and the communication hole 92 is disposed proximately to the suction port 84*a*. Here, the partition plate 88 is disposed across the deepest bottom section of the ice-making water tank 82 and therefore, the communication hole 92 is positioned at the deepest bottom section. The partition plate 88 is set so that its upper end is positioned above a maximum storable water level of the ice-making water stored in the ice-making water tank 82.

(Circulating Tank Section)

The above-mentioned circulating tank section 84 is positioned at the support axis 23 in the ice-making water tank 82 and set so as to have a capacity smaller than that of the above-mentioned retention tank section 86. However, in light of the factors required for ice-making operation, such as a capability of the pump motor 30, an ice-making rate in the above-mentioned ice-making compartments 16, and the amount of water required when it circulates through supply pipes 32,34, the water tray 22, and other elements forming a circulation route, the capacity of the circulating tank section 84 is set to a value at which air is not taken into the pump motor 30 by a shortage of ice-making water. Accordingly, there is a constant convection of ice-making water into the circulating tank section 84 during ice-making operation. The suction port 84*a* of the pump motor 30 is provided on the side face (associated with the circulating tank section 84) where the pump motor 30 of the ice-making water tank 82 is installed.

(Retention Tank Section)

The retention tank section 86 communicating with the above-described circulating tank section 84 via the communication hole 92 is positioned at an open end of the above-described ice-making water tank 82 (i.e., at the side opposite to the support axis and becoming a lower end when facing an opening position), and set to have a capacity greater than that of the circulating tank section 84. The retention tank section 86 has its bottom sloped downward toward the communication hole 92 in the partition plate 88, whereby the ice-making water retained will be led toward the communication hole 64. In addition, in the retention tank section 86, a draining hole 94 is provided at a sloped open upper end of the ice-making water tank 82. In the ice-making mechanism 80 of Embodiment 2, when deicing operation is completed and switched to ice-making operation, tap water of ordinary temperature is supplied from a water supply pipe 38 to the retention tank section 86, and the tap water (ice-making water) exceeding the amount of ice-making water required for ice-making operation is drained from the draining hole 94 into the drainage tray 36. That is, the amount of ice-making water stored in the ice-making water tank 82 is defined by a position of the draining hole 94. During deicing operation, the ice-making water left in the ice-making water tank 82 sloped integrally with the water tray 22 is drained into the drainage tray 36 positioned below, via the draining hole 94.

(Guide)

Figure 7:
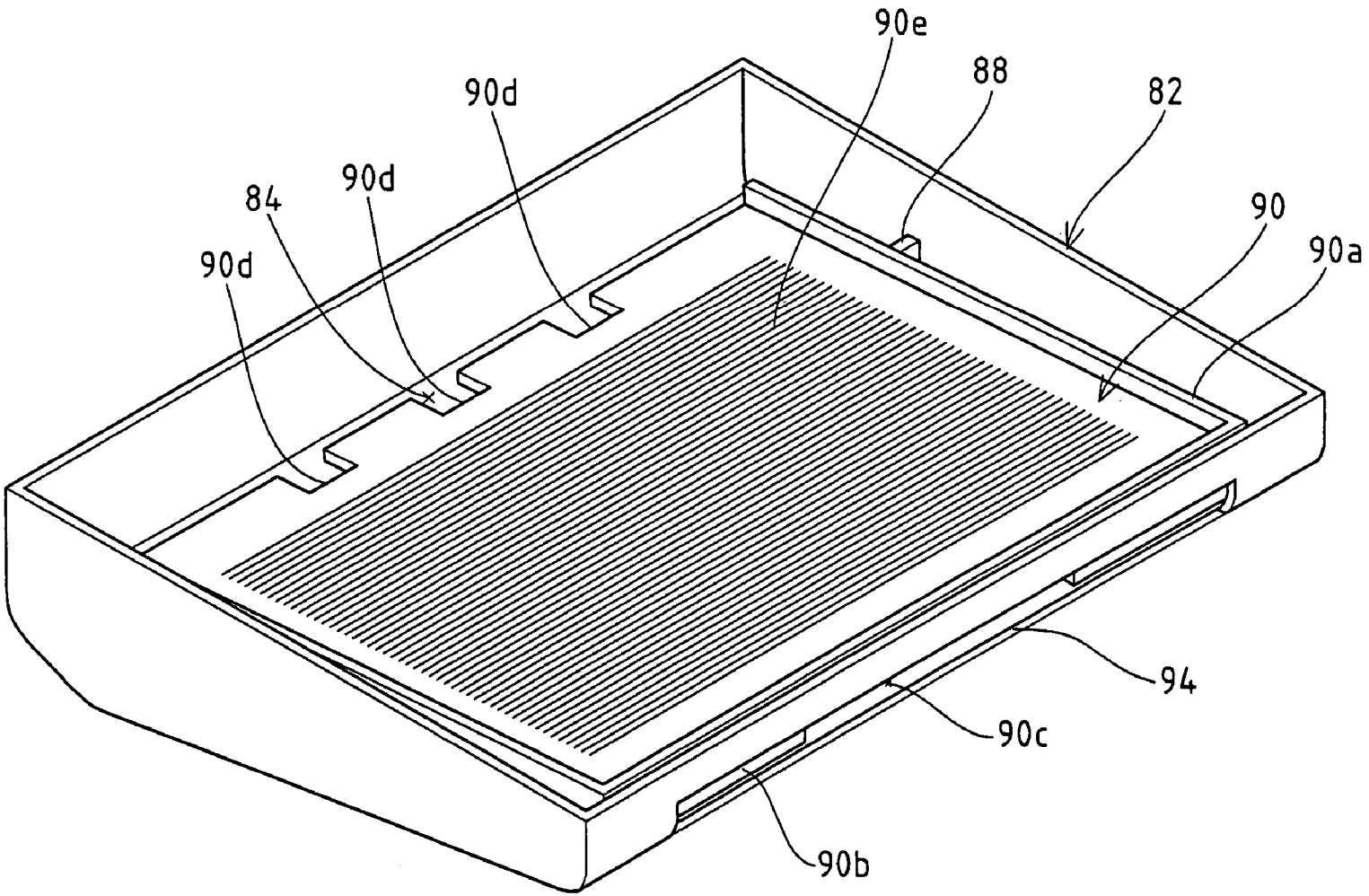
FIG. 7 is a schematic perspective view showing an ice-making water tank in Embodiment 2.
Figure 9:
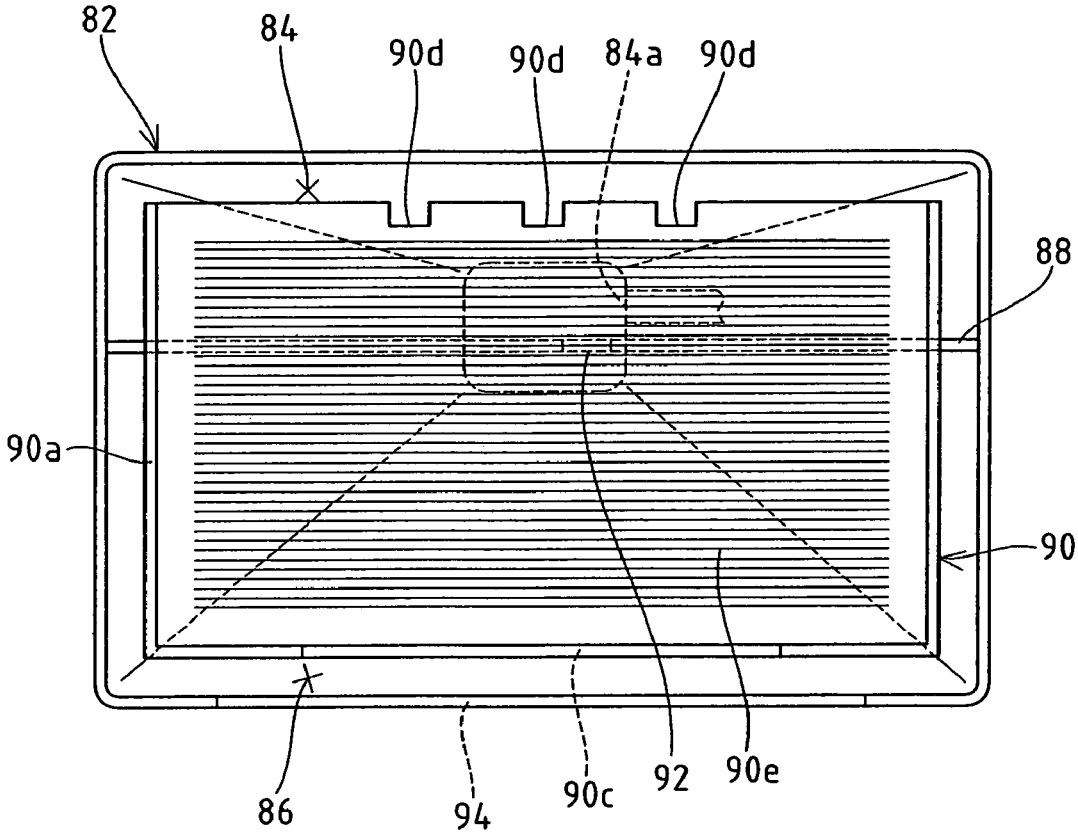
FIG. 9 is a plan view showing the ice-making water tank of Embodiment 2.

As shown in FIG. 7 or 9, a guide 90 extending so as to provide covering at least above the retention tank section 86 described above is removably disposed inside the above-described ice-making water tank 82. The guide 90 is, for example, a plate-like body made of synthetic resin, and it is rested on the partition plate 88, extends not only above the retention tank section 86, but also above the circulating tank section 84, and thereby provides covering above the suction port 84*a* that opens toward the circulating tank section 84. The guide 90 is formed with, at its ends including an end which faces the circulating tank section 84, a guide wall 90*a* rising from a surface of the guide 90 (see FIG. 8). In addition, at an end of the guide 90, associated with an open end of the ice-making water tank 82, i.e., at an end proximate to the draining hole 94), a hanging portion 90*b* extending from a lower face of the above-mentioned end is provided and when a lower end of the hanging portion 90*b* abuts on a bottom of the retention tank section 86, the above end of the guide 90 that faces the above-mentioned open end becomes spaced from the above-mentioned lower face at fixed intervals. This retains the guide 90 in a downwardly sloped condition as it goes away from the foregoing open end toward the support axis 23. The hanging portion 90*b* is notched at a discharge port 90*c* from which excess water and the ice-making water left inside are discharged.

The end of the guide 90 that faces the circulating tank section 84 is positioned above a section at which a water level of the ice-making water stored within the circulating tank section 84 is low (i.e., at an upper end present on the sloped bottom of the circulating tank section 84), and that end of the guide 90 is adapted so that a downwardly flowing position of the un-iced water guided to the circulating tank section 84 along the guide 90 will be spaced from the suction port 84*a*. Here, since the end of the guide 90 that faces the circulating tank section 84 approaches the sidewall facing the support axis 23 in the ice-making water tank 82 and thus narrows a clearance present between the end of the guide 90 and the sidewall, the end of the guide 90 that faces the circulating tank section 84 is recessed at a plurality of flow-down ports 90*d*. This means that the un-iced water dripping into the ice-making water tank 82 via the return holes 25 of the water tray 22 is guided from the guide 90 facing a reverse side of the water tray 22, to the circulating tank section 84, in order to prevent direct flow-down into the retention tank section 86.

In addition, the surface of the guide 90 is subjected to surface treatment (processing) to obtain great frictional resistance. In Embodiment 2, by denting the surface of the guide 90 by use of a grinding tool/material such as a sandpaper, thin stripe-like grooves 90*e* extending in a direction orthogonal to a downward flowing direction of un-iced water (i.e., in the same direction as the axial direction of the support axis 23) are provided to capture, for example, the flock of ice flowing downward along the surface of the guide 90 (see FIG. 9).

The guide 90 is rested on the partition plate 88 and makes the above-mentioned hanging portion 90*b* abut on the bottom of the retention tank section 86 so that an end facing the circulating tank section 84 is retained in a downwardly sloped condition to function as a sloped lower end (see FIG. 5). In addition, the guide 90 is constructed so that with the partition plate 88 as a fulcrum, the hanging portion 90*b* (an end associated with the open end of the ice-making water tank 82) is able to move in an upward direction (the direction in which the hanging portion 90*b* becomes spaced from the bottom of the retention tank section 86) and in a downward direction (the direction in which the hanging portion 90*b* approaches the foregoing bottom). More specifically, the guide 90 is adapted so that when the ice-making water tank 82 inclines in a downward direction (opening direction) integrally with the water tray 22, the ice-making water left in the retention tank section 86 causes the end facing the open end of the guide 90 to slope upward with the partition plate 88 as a fulcrum, thus spacing the hanging portion 90*b* from the bottom of the retention tank section 86, and consequently opening the draining hole 94 widely to make smooth draining of residual ice-making water from the draining hole 94 permissible (see FIG. 6). Furthermore, at the guide 90, when the ice-making water tank 82 inclines in an upward direction (closing direction) integrally with the water tray 22, an end associated with the open end of the guide 90 inclines downward under its own weight with the partition plate 88 as a fulcrum, thus abutting the hanging portion 90*b* on the bottom of the retention tank section 86, and consequently regulating a position. In short, the guide 90 is adapted so that its end associated with the open end of the ice-making water tank 82 can be inclined, with the partition plate 88 as a fulcrum, in a reverse direction to the inclining direction of the ice-making water tank 82.

[Operation of Embodiment 2]

Next, the operation of the ice-making mechanism of an ice-making machine in Embodiment 2 is described below. First, an ice-making process by the ice-making mechanism in Embodiment 2 is briefly described using FIG. 5 or 6. During ice-making operation, the water tray 22 and ice-making water tank 82 in the above-mentioned ice-making mechanism close the ice-making compartments 16 from below and are positioned horizontally and each water-spraying hole 24 faces an associated ice-making compartment 16. When ice-making operation is started, a refrigerant circulates into the evaporation pipe 18 and the ice-making compartments 16 are force-cooled. Also, the ice-making water in the ice-making water tank 82 is pressure-fed to the water tray 22 by the pump motor 30 and after being spray-supplied to each ice-making compartment 16 via each water-spraying hole 24 to start icing in a laminar form. Un-iced water, i.e., water that has not become iced after being sprayed into the ice-making compartments 16 flows downward through the return holes 25 in the water tray 22, then drips onto the guide 90 positioned below the water tray 22, and further flows downward along a slope of the guide 90. After this, the un-iced water is dropwise collected from the flow-down ports 90*d* and the end facing the circulating tank section 84 into the circulating tank section 58 (see FIG. 5). At this time, since the guide walls 90*a* rising from the surface of the guide 90 are provided at its ends including the end that faces the circulating tank section 84, the un-iced water dripping onto the surface of the guide 90 is prevented from splashing toward regions other than the circulating tank section 84. Consequently, the un-iced water can be effectively collected into the circulating tank section 84 and recirculated. That is to say, the un-iced water is collected only into the circulating tank section 84 and does not flow directly into the retention tank section 86 by being blocked at the guide 90. When ice-making operation progresses and ice cubes 46 are produced in the ice-making compartments 16, this is detected by a required sensor and the operation is switched to deicing operation.

During deicing operation, a hot gas is supplied to the evaporation pipe 18. Thus, the ice-making compartments 16 are heated and the water tray 22 and the ice-making water tank 82 are sloped downward with the support axis 23 as a fulcrum by a water tray inclining mechanism in order to open lower sections of the ice-making compartments 16. The ice cubes 46 thus released from the ice-making compartments 16 drop onto the sloped water tray 22, then slide obliquely in a downward direction, and are delivered to the ice storage compartment (see FIG. 6). In addition, as the ice-making water tank 82 inclines, the ice-making water left in the circulating tank section 84 flows into the retention tank section 86 via the communication hole 92, and this amount of ice-making water left in the retention tank section 86 is discharged from the draining hole 94 of the ice-making water tank 82 via the discharge port 90*c* of the guide 90 and collected into the drainage tray 36 positioned below. Here, in terms of the spacing between the end facing the open end of the guide 90 and the lower face of the ice-making water tank 82 that is associated with the above-mentioned end, since the lower face of the ice-making water tank 82 is formed with a slope, the above-mentioned end and lower face approach each other and the discharge port 90*c* cannot be increased in an opening area and becomes smaller than the draining hole 94. In short, there is difficulty in that the guide 90 narrows the draining hole 94, and because of this difficulty, if the opening area of the draining hole 94 is too small, since the progress of the inclination of the ice-making water tank 82 causes residual ice-making water to be drained rapidly, the residual ice-making water could splash toward sections other than the drainage tray 36. However, since the guide 90 in Embodiment 2 is adapted so that an open end at which the discharge port 90*c* is provided is inclinable vertically around the partition plate 88, when the ice-making water tank 82 inclines downward, the open end of the guide 90 is inclined upward by residual ice-making water to space the hanging portion 90*b* from the bottom of the retention tank section 86. As a result, the draining hole 94 opens widely and the residual ice-making water is drained smoothly and does not splash toward sections other than the drainage tray 36.

In this way, in the closed-cell type of ice-making mechanism 80, the ice-making water in the ice-making water tank 82 is replaced during one ice-making process cycle. Therefore, unlike the open-cell type of ice-making mechanism used by adding ice-making water to residual one, the closed-cell type of ice-making mechanism 80 does not increase the concentrations of any impurities present in the ice-making water retained in the ice-making water tank 82 and makes ice cubes less likely to become cloudy. When an ice cube 46 is discharged from an ice-making compartment 16, the water tray opening/closing mechanism inversely operates to return the water tray 22 and the ice-making water tank 82 to a horizontal position, thus closing the ice-making compartments 16 from below once again. At the same time, an end associated with the open end of the guide 90 inclines downward under its own weight, thus abutting the hanging portion 90*b* on the bottom of the retention tank section 86, and consequently causes water to be further supplied from the water supply pipe 38 to the retention tank section 86 so as to prepare this tank section for next ice-making operation.

Even in the construction of Embodiment 2, as described in Embodiment 1, the ice-making water tank 82 is internally divided into the circulating tank section 84 and the retention tank section 86, and the guide 90 guides only to the circulating tank section 84 the ice-making water not becoming iced in the ice-making chamber 12. Accordingly, the ice-making mechanism 80 in Embodiment 2 operates similarly to that of Embodiment 1 in that: (1) during ice-making operation, since ice-making water is constantly circulating through the circulating tank section 84, the circulation prevents the flocculation of ice, cools the ice-making water within a short time, and thus improves ice-making efficiency, and since impurities do not increase in concentration, inconvenience such as clouding or early fusing of ice cubes 46 is avoided; and (2) because of its relatively high temperature compared with the temperature of the ice-making water stored within the circulating tank section 84, the ice-making water in the retention tank section 86 suppresses the flocculation of ice by preventing the ice-making water within the circulating tank section 84 from being supercooled. Therefore, aspects in which the construction of Embodiment 2 differs from that of Embodiment 1 are further described below.

The guide 90 covers entirely above the retention tank section 86, and also covers the suction port 84*a* provided in the circulating tank section 84. Accordingly, the un-iced water dripping onto the guide 90 is guided only to the circulating tank section 84 along the slope of the guide 90, and the un-iced water flowing downward from the end of the guide 90 is capable of suppressing the waving of the water surface near the suction port 84*a*. There are difficulties that if the waving near the suction port 84*a* results from downward movement of un-iced water, the pump motor 30 is likely to entrain air, and that if the pump motor 30 actually entrains air, ice-making water is not stably supplied to the ice-making compartments 16 and the ice cubes 46 obtained may be cloudy. That is to say, any effects of the waving of a water surface due to un-iced water on the suction port 84*a* can be relieved by providing a covering above the suction port 84*a* by means of the guide 90 so that un-iced water flows downward at a position spaced from the suction port 84*a*. In addition, any effects of waving due to the un-iced water guided to the suction port 84*a* and flowing downward into the circulating tank section 84 can be further suppressed by positioning the end of the guide 90 that faces the circulating tank section 84, at a position spaced from the suction port 84*a* and equivalent to a section at which the water level of the ice-making water stored within the circulating tank section 84 is low (i.e., the upper end of the sloped bottom of the tank section 84). Therefore, it becomes possible to stabilize the amount of ice-making water taken in by the pump motor 30, and to suppress inconvenience such as the clouding of ice cubes 46 due to changes in the amount of ice-making water sprayed into the ice-making compartments 16.

Here, during ice-making operation, in order to prevent the waving of the ice-making water circulating through the circulating tank section 84, the end of the guide 90 that faces the circulating tank section 84 is extended to a position at which the water level of the ice-making water stored within the circulating tank section 84 is low. That is, since the end of the guide 90 that faces the circulating tank section 84 is positioned proximately to the sidewall of the ice-making water tank that faces the support axis 23, the clearance between the above-mentioned end and sidewall is narrowed and this is likely to cause clogging with flock of ice or the like. In Embodiment 2, however, blocking due to flock of ice or the like can be avoided since a plurality of flow-down ports 90*d* are provided at the end of the guide 90 that faces the circulating tank section 84.

The flock of ice that clogs the suction port 84*a* or the water-spraying holes 24 and impedes stable supply of ice-making water may occur not only in the mode where they are caused by the supercooling of the ice-making water stored within the ice-making water tank 82, but also in the ice-making chamber 12 where they stem from the ice-making water supplied to the ice-making compartments 16. In the latter case, these flocks of ice may be entrained in the un-iced water dripping from the water tray 22. However, since the surface of the guide 90 that faces the reverse side of the water tray 22 is formed with thin grooves 90*e* to give great frictional resistance, the grooves 90*e* are able to suppress the inflow of flocculated ice and the like into the circulating tank section 84 by acting as resistance to downward flow of the flocculated ice along the surface of the guide 90 and capturing the flocculated ice in a hooked condition at the grooves 90*e*. In addition, by setting to have a large value the frictional resistance occurring on the surface of the guide 90, not only flocks of ice but also other impurities can be captured on the surface of the guide 90 and thus the entry of impurities into ice cubes 46 can be prevented. Besides, since the guide 90 is removably disposed, it can be easily cleaned and this makes the re-entry of impurities suppressible. Here, not only the surface of the guide 90 may be formed with grooves 90*e* by, for example, denting for increased frictional resistance, but also, provided that the frictional resistance on the surface increases, may, of course, the guide 90 be similarly grooved before being molded or may the guide 90 itself be made of a material having frictional resistance, or may the guide 90 be constructed in some other such manner.

Of course, the construction in which the guide 90 described in Embodiment 2 provides covering above the suction port 84*a*, the construction in which a guide wall 90*a* is provided on the guide 90, the construction in which the frictional resistance on the surface of the guide 90 is increased, and other forms of construction can also be applied to the open-cell type of ice-making mechanism in Embodiment 1 described above.

[Modification Examples]

Provided that the guide described above is adapted so as to accept the un-iced water dripping from the water tray 22 and guide the dripping un-iced water to the circulating tank section and in order for no such water to flow directly into the retention tank section, it is likewise possible to employ the construction in which the guide has a smooth and flat surface, or the construction in which the guide is fixed. In addition, in terms of the relationship in position between the circulating tank section 84 and retention tank section 86 in Embodiment 2, both tank sections are formed in parallel to a direction orthogonal to the axial direction of the support axis 23 by being separated by the partition plate 88 extending in the axial direction of the support axis 23. However, a partition plate extending in a direction orthogonal to the axial direction of the support axis 23 may be used to separate the above two tank sections so as to make both parallel to the same direction as the axial direction of the support axis 23. Instead, the partition plate may be formed into a leftwardly open box-like shape that consists of a first wall extending in the axial direction of the support axis 23 and one pair of second walls spaced in the axial direction of the support axis 23 and extending from the pivotally supported end of the ice-making water tank 54,82, toward an open ends thereof, wherein the partition plate of the box-like shape opens toward the open end of the ice-making water tank 54,82 when viewed planarly, and a guide may be rested on this partition plate. At this time, instead of providing a hanging portion at the above guide, a space formed between the end of the guide that faces the open end of the ice-making water tank 54,82 and the bottom of the retention tank section may be used as a discharge port. Furthermore, regarding the guide, the end thereof that faces the circulating tank section may be bent into a hanging shape for reduced flow-down distance from ice-making water so that waving due to downward flow of un-iced water can be suppressed.

According to the ice-making mechanism of an ice-making machine of the present invention, since the ice-making water tank is divided into a circulating tank section and a retention tank section and constructed so that the un-iced water cooled during ice-making operation is not allowed to flow directly into the retention tank section and flows only into the circulating tank section, it is possible to cool ice-making water within a short time and thus to improve ice-making efficiency. In addition, the ice-making water stored in both tank sections suppresses an increase in concentrations of impurities. Furthermore, supercooling of the ice-making water circulated through the circulating tank section during ice-making operation can be prevented by means of the high-temperature ice-making water retained in the retention tank section, and consequently, the flocculation of ice is suppressible. Besides, supplying water to the retention tank section allows effective use of the ice-making water within the circulating tank section that was cooled during the previous ice-making operation. Consequently, it becomes possible to suppress an energy loss, reduce the time required for the next ice-making operation, reduce the power consumption required for the making of ice, and improve ice-making efficiency.

In addition, by providing in the retention tank section a draining hole for draining excess ice-making water from the ice-making water tank, it is possible to prevent excessive outflow of ice-making water from the ice-making water tank due to downward movement of un-iced water and thus to save water.

Extending the above-mentioned guide means so as to provide covering above the suction port of the pump motor makes the suction port less susceptible to any effects of the waving of ice-making water due to the inflow of un-iced water into the circulating tank section while the un-iced water is guided by the guide means. In other words, when ice-making water is taken in from the suction port by the pump motor, entrainment of air is prevented and this is advantageous in that ice-making water is stably supplied to the ice-making unit. In addition, by providing a treatment that increases the frictional resistance on a surface of the guide means, the inflow of any flocks of ice flowing downward along the surface of the guide means, into the circulating tank section, is suppressed and the problem of ice-making defects arising from the flocculation of ice is avoidable. By constructing the above-mentioned guide means so as to be tiltably supported by the ice-making water tank and so that when the ice-making water tank inclines downward, the end of the guide means that is proximate to the draining hole is spaced with respect to the bottom of the ice-making water tank, the end of the guide means that is proximate to the draining hole is significantly spaced from the bottom of the ice-making water tank during the draining of the ice-making water left therein, whereby the draining of the ice-making water left in the ice-making water tank can be accelerated.

Furthermore, since the retention tank section has a cover that provides covering above the pump motor, it is possible to keep the pump motor free from water and thereby to prevent trouble and the like from occurring. Besides, since the cover is not an independent member, it is possible to reduce the number of parts required and that of man-hours required for assembly and thus to reduce costs.

The invention claimed is:

1. An ice-making mechanism of an ice-making machine which is adapted so that ice-making water stored within an ice-making water tank disposed below an ice-making unit cooled by an evaporating pipe is supplied to said ice-making unit via a pump motor and so that the ice-making water not becoming iced in said ice-making unit is collected into said ice-making water tank and recirculated, wherein:

said ice-making water tank comprises a circulating tank section to which said pump motor connects, and a retention tank section set to a capacity greater than that of said circulating tank section, wherein said circulating tank section and said retention tank section communicate with each other; and guide means is provided above said ice-making water tank, said guide means guiding only to said circulating tank section the ice-making water un-iced in said ice-making unit, said ice-making mechanism being characterized in that:

a suction port of said pump motor is provided in a vicinity of a deepest bottom section of said circulating tank section, said suction port being connected to said pump motor;

supply of ice-making water to said ice-making water tank is performed to said retention tank section when an amount of ice-making water inside said circulating tank section is reduced; and ice-making water supplied to said retention tank section is then supplied to said circulating tank section.

2. The ice-making mechanism of an ice-making machine according to claim 1, wherein a draining hole for draining excess ice-making water from said ice-making water tank is disposed in said retention tank section.

3. The ice-making mechanism of an ice-making machine according to claim 1, wherein said guide means extends above said suction port.

4. The ice-making mechanism of an ice-making machine according to claim 1, wherein said guide means is adapted so as to be inclinably supported in said ice-making water tank and so that when said ice-making water tank inclines downward, said guide means spaces with respect to a bottom of the ice-making water tank the end of said guide that is proximate to said draining hole, whereby draining of the ice-making water left in said ice-making water tank is accelerated.

5. The ice-making mechanism of an ice-making machine according to claim 1, wherein, in said retention tank section, a cover for providing a covering above said pump motor is integrally formed.

6. An ice-making mechanism of an ice-making machine which is adapted so that ice-making water stored within an ice-making water tank disposed below an ice-making unit cooled by an evaporating pipe is supplied to said ice-making unit via a pump motor and so that the ice-making water not becoming iced in said ice-making unit is collected into said ice-making water tank and recirculated, wherein:

said ice-making water tank comprises a circulating tank section to which said pump motor connects, and a retention tank section set to a capacity greater than that of said circulating tank section, wherein said circulating tank section and said retention tank section communicate with each other;

guide means is provided above said ice-making water tank, said guide means guiding only to said circulating tank section the ice-making water un-iced in said ice-making unit; and a surface of said guide means is subjected to treatment for increasing frictional resistance in order to block downward flow of flocks of ice.

* * * * *